US009546453B2

(12) United States Patent
Springer

(10) Patent No.: US 9,546,453 B2
(45) Date of Patent: Jan. 17, 2017

(54) METHOD FOR TAMPING A TRACK BY MEANS OF ASYNCHRONOUSLY MOVED TAMPING UNITS

(71) Applicant: Plasser & Theurer Export von Bahnbaumaschinen Gesellschaft m.b.H., Vienna (AT)

(72) Inventor: Heinz Springer, Tokyo (JP)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 105 days.

(21) Appl. No.: 14/431,185

(22) PCT Filed: Oct. 1, 2013

(86) PCT No.: PCT/EP2013/002944
§ 371 (c)(1),
(2) Date: Mar. 25, 2015

(87) PCT Pub. No.: WO2014/063776
PCT Pub. Date: May 1, 2014

(65) Prior Publication Data

US 2015/0233062 A1 Aug. 20, 2015

(30) Foreign Application Priority Data

Oct. 24, 2012 (AT) ..... A 1148/2012

(51) Int. Cl.
*E01B 27/16* (2006.01)

(52) U.S. Cl.
CPC ..... *E01B 27/16* (2013.01)

(58) Field of Classification Search
CPC ..... E01B 27/16; E01B 27/17; E01B 27/18; E01B 27/13; E01B 27/12
USPC ..... 104/2, 10, 12
See application file for complete search history.

(56) References Cited

U.S. PATENT DOCUMENTS

| | | | | |
|---|---|---|---|---|
| 4,369,712 | A * | 1/1983 | von Beckmann | E01B 27/16 104/12 |
| 4,913,058 | A * | 4/1990 | Mancini | E01B 27/16 104/12 |
| 4,942,821 | A * | 7/1990 | Rossanigo | B06B 1/12 104/12 |
| 5,133,263 | A * | 7/1992 | Theurer | E01B 27/16 104/12 |
| 5,706,734 | A * | 1/1998 | Theuerer | E01B 27/17 104/12 |

(Continued)

FOREIGN PATENT DOCUMENTS

| | | |
|---|---|---|
| DE | 24 24 829 A1 | 1/1976 |
| DE | 41 12 224 A1 | 10/1991 |

(Continued)

OTHER PUBLICATIONS

International Search Report of PCT/EP2013/002944, dated Dec. 13, 2013.

*Primary Examiner* — Mark Le
(74) *Attorney, Agent, or Firm* — Collard & Roe, P.C.

(57) ABSTRACT

For tamping two adjacent sleepers (9) of a track (3), the joint lowering of two adjoining tamping units (2) takes place with a time delay. As a result, the immersion in particular of immediately adjacent inner tamping tines (20) plunging into a common sleeper crib (18) is facilitated.

3 Claims, 1 Drawing Sheet

(56) References Cited

U.S. PATENT DOCUMENTS 6,389,979 B1 * 5/2002 Theurer ..... E01B 27/16
104/10

FOREIGN PATENT DOCUMENTS

| | | | |
|---|---|---|---|
| EP | 0 314 933 | A1 | 5/1989 |
| WO | 2011/023257 | A1 | 3/2011 |

* cited by examiner

Fig. 1
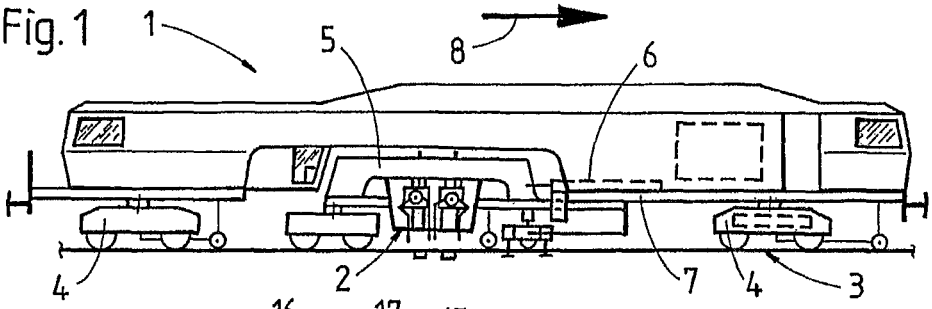
Fig. 2
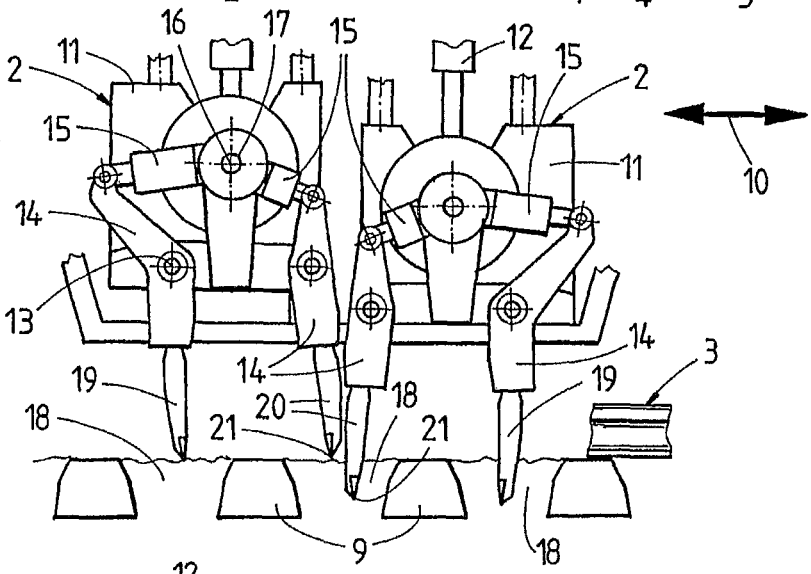
Fig. 3
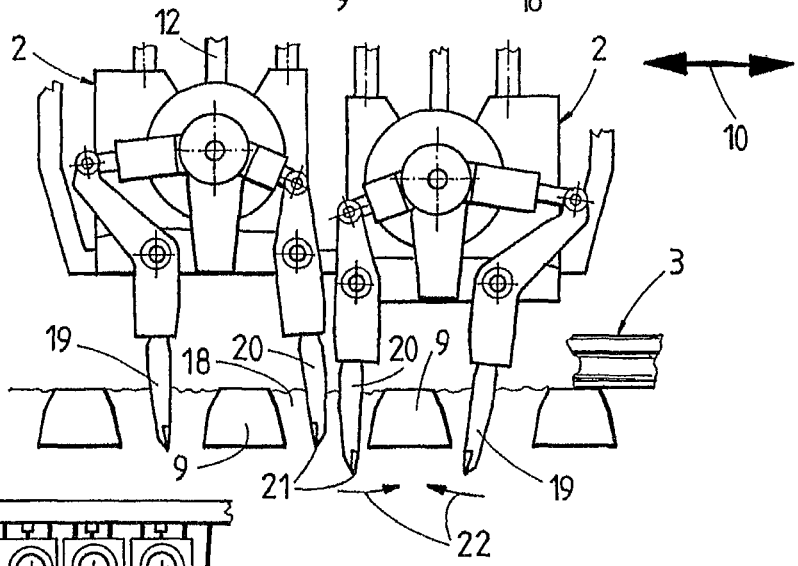
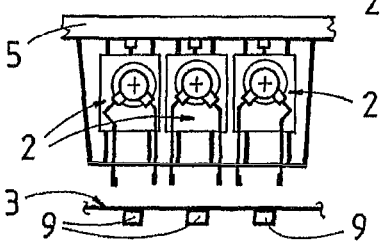
Fig. 4

METHOD FOR TAMPING A TRACK BY MEANS OF ASYNCHRONOUSLY MOVED TAMPING UNITS

CROSS REFERENCE TO RELATED APPLICATIONS

This application is the National Stage of PCT/EP2013/002944 filed on Oct. 1, 2013, which claims priority under 35 U.S.C. §119 of Austrian Application No. A 1148/2012 filed on Oct. 24, 2012, the disclosures of which are incorporated by reference. The international application under PCT article 21(2) was not published in English.

BACKGROUND OF THE INVENTION

1. Field of the Invention

The invention relates to a method of tamping at least two adjacent sleepers of a track by means of at least two tamping units arranged one following the other in a longitudinal machine direction or working direction and designed to be lowered independently of one another, having inner tamping tines provided for immersion into the same sleeper crib as well as outer tamping tines provided for immersion into a sleeper crib singly.

2. Description of the Related Art

According to WO 2011023257 A2, both tamping units provided for tamping a track can be lowered jointly for simultaneous tamping of two adjacent sleepers. If a track obstacle is present, it is also possible to employ only one of the two tamping units, as required, in order to be able to tamp at least a single sleeper in this special situation.

SUMMARY OF THE INVENTION

It is the object of the present invention to provide a method of the type mentioned at the beginning with which an improvement of the tamping operation can be attained.

According to the invention, this object is achieved with a method of the specified type in that the joint lowering of adjoining tamping units for tamping sleepers adjacent in the longitudinal direction of the machine takes place with a time delay.

Due to this time-delayed lowering, one of the two inner tamping tines plunging into the same sleeper crib is immersed in the ballast earlier, whereby the resulting ballast displacement is practically cut in half as compared to the known method. This leads to significantly easier penetration particularly into encrusted ballast, so that the effects of wear and tear are reduced on both the ballast and the tamping unit. Furthermore, the vibration of the preceding inner tamping tine sets the surrounding ballast in flowing motion and thus facilitates the penetration by the following second inner tamping tine. Additionally, the already starting squeezing motion of the preceding inner tamping tine facilitates the following immersion of the second tamping tine.

Additional advantages of the invention become apparent from the dependent claims and the drawing description.

BRIEF DESCRIPTION OF THE DRAWINGS

The invention will be described in more detail below with reference to an embodiment represented in the drawing in which FIG. 1 shows a side view of a machine for tamping a track, FIGS. 2 and 3 each show an enlarged side view of a tamping unit, and FIG. 4 shows a simplified side view of a further tamping unit.

DETAILED DESCRIPTION OF THE PREFERRED EMBODIMENTS

A machine, 1, shown in FIG. 1, has a tamping unit 2 for tamping a track 3. In order to increase the efficiency of the machine 1, a satellite frame 5 arranged between on-track undercarriages 4 is displaceable by means of a drive 6 relative to a machine frame 7. Thus, the latter can be moved continuously in the working direction, indicated by an arrow 8, during the tamping of the track 3.

As can be seen better in FIGS. 2 and 3, two tamping units 1 are provided for simultaneously tamping two adjacent sleepers 9, the tamping units being arranged one following the other in a longitudinal machine direction or working direction 10 and each having an assembly frame 11. For vertical adjustment independently of one another, a separate drive 12 is associated with each tamping unit, respectively.

Each tamping lever 14, mounted for pivoting about a pivot axis 13 on an assembly frame 11, is connected to a squeeze drive 15. Each squeeze drive 15 is mounted on a common eccentric shaft 17 having an eccentricity with regard to an axis of rotation 16.

Arranged at either end of each tamping unit 2, with regard to the longitudinal direction 10 of the machine, is a respective outer tamping tine 19 which is connected to a tamping lever 14 and provided for immersion into a sleeper crib 18 by itself. Provided for common immersion into the same sleeper crib 18 are two inner tamping tines 20, arranged one following the other in the longitudinal direction 10 of the machine and each connected to a tamping lever 14. Of these two inner tamping tines 20, the front one with regard to the working direction is in each case connected to the front tamping unit 2, and the rear one to the rear tamping unit 2.

The cycle-like tamping operation is initiated by lowering both tamping units 2 and continues with a squeezing motion of inner tamping tines 20 towards the adjacent outer tamping unit 19 in each case for compaction of the ballast located underneath the respective sleeper 9.

Now, in keeping with the method according to the application, one of the two drives 12 is actuated earlier than the drive 12 of the adjacent tamping unit 2. As a result, the common lowering of the adjacent tamping units 2 for tamping the sleepers 9 adjoining in the longitudinal direction of the machine takes place with a time delay. The time delay in actuating the second drive 12 preferably ranges from about 100 to about 300 milliseconds. The resulting vertical distance between a tine tip 21 of the preceding tamping unit 2 and the tine tip 21 of the following tamping unit 2 measures preferably about 150 millimeters. In this, it makes no difference in principle which of the two tamping units 2 is lowered earlier.

As shown in FIG. 3, the squeezing motion (arrow 22)—causing a tamping of the sleeper 9—for the tamping tines 19, 20 associated with the preceding tamping unit 2 takes place earlier than the squeezing motion for the tamping tines 19, 20 of the following tamping unit 2.

After a lifting of the two tamping units 2, these are transported onward for tamping the adjoining sleepers 9, where the above-described tamping cycle with the time-delayed lowering is repeated.

As indicated schematically in FIG. 4, it would also be possible to arrange, for example, three tamping units 2 one following the other for tamping three adjacent sleepers 9. In this case, either the central tamping unit 2, or also both the front-most and rear-most tamping unit 2 together, could be lowered ahead of time.

The invention claimed is:

1. A method of tamping at least adjacent first and second sleepers of a track by at least first and second adjoining tamping units arranged one following the other in a longitudinal machine direction or working direction and designed to be lowered independently of one another, wherein an inner sleeper crib is disposed between the first and second sleepers and first and second outer sleeper cribs are disposed outside the first and second sleepers, respectively, wherein the first tamping unit has a first inner tamping tine and a first outer tamping tine and the second tamping unit has a second inner tamping tine and a second outer tamping tine and the first and second inner tamping tines are provided for immersion into the inner sleeper crib and the second outer tamping tines are provided for immersion into the first and second outer sleeper crib respectively, wherein the method comprises:

joint lowering of the first and second adjoining tamping units for tamping the first and second sleepers adjacent in the longitudinal direction of the machine; and wherein the joint lowering takes place with a time delay between lowering of the first tamping unit and lowering of the second tamping unit, during the joint lowering.

2. The method according to claim 1, wherein the time delay takes place within the range of about 100 to about 300 milliseconds.

3. The method according to claim 1, wherein a first squeezing motion causing a tamping of the first sleeper for the first inner tamping tine and the first outer tamping tine associated with the first tamping unit preceding the second tamping unit takes place earlier than a second squeezing motion for the second inner tamping tine and the second outer tamping tine of the second tamping unit.

* * * * *